United States Patent [19]

Gillis

[11] Patent Number: 4,960,225

[45] Date of Patent: Oct. 2, 1990

[54] COVER STRUCTURE FOR BEVERAGE CANS OR LIKE CONTAINERS

[76] Inventor: Rolando Gillis, 12908 SW. 48th St., Miami, Fla. 33175

[21] Appl. No.: 403,874

[22] Filed: Sep. 7, 1989

[51] Int. Cl.[5] ..... B65D 90/12

[52] U.S. Cl. ..... 220/85 H; 220/903; 215/100.5

[58] Field of Search ..... 220/85 H, 904, 903; 215/100.5; 150/154, 901; 224/148, 906

[56] References Cited

U.S. PATENT DOCUMENTS

| | | | |
|---|---|---|---|
| 864,556 | 8/1907 | Reiter | 215/100.5 X |
| 1,173,645 | 2/1916 | Blount | 229/DIG. 4 X |
| 1,632,347 | 6/1927 | Pipkin | 215/100.5 |
| 1,891,892 | 12/1932 | Pipkin | 215/100.5 |
| 2,058,915 | 10/1936 | Scholl | 215/100.5 |
| 2,081,409 | 5/1937 | Rush | 215/100.5 X |
| 2,670,616 | 3/1954 | Schneider | 220/85 H |
| 3,738,529 | 6/1973 | Rose | 220/85 H |
| 4,583,577 | 4/1986 | Canfield | 215/100.5 X |

FOREIGN PATENT DOCUMENTS

| | | | |
|---|---|---|---|
| 0413744 | 5/1925 | Fed. Rep. of Germany | 215/100.5 |
| 1280756 | 11/1961 | France | 206/178 |

*Primary Examiner*—Stephen Marcus
*Assistant Examiner*—Nova Stucker
*Attorney, Agent, or Firm*—Malloy, Downey & Malloy

[57] ABSTRACT

A cover structure for a beverage containing can or like container which removably slides over the exterior surface thereof and which is preferably formed from a cardboard or like flexible material which is disposable after one or more uses and which provides ample exposed surface area on the continuous wall structure thereof to provide decorative, informative or other predetermined indicia and further being structured to maintain the bottom of the container in spaced relation to a supporting surface such as a table or the like.

11 Claims, 1 Drawing Sheet

COVER STRUCTURE FOR BEVERAGE CANS OR LIKE CONTAINERS

BACKGROUND OF THE INVENTION

1. Field of the Invention

This invention relates to a cover structure which is designed to be removably secured to at least a portion, but preferably a majority of the outer wall surface of a beverage container, such as a can or the like of the type sold to consumers especially wherein the beverage is consumed directly from the can or poured into a glass. The cover may serve a utilitarian function of absorbing certain condensation as well as providing ample exposed surface area on the cover for decoration, advertising or the like.

2. Description of the Prior Art

It is, of course, quite well known to provide coaster structures on which to rest beverage containers, such as cups, glasses, cans or the like. Typically, such coasters are used to protect a supporting surface, such as a table top or the like, from being damaged due to the resting of the container thereon. Such coaster structures may be structured for repeated use or may be disposable and formed from a lightweight paper or like product.

In addition to the above known prior art structures, it is also well known to include an insulating jacket or cover normally having a continuous, cylindrical wall disposed in surrounding confronting relation to the outer surface of the container and a bottom, closed end of the continuous cylindrical wall on which the bottom of the container rests. Normally, such prior art cover structures are formed of an insulative material which is flexible and/or elastic and which serves to insulate the beverage within the container so as to maintain such beverage either at a reduced or increased temperature as desired. Again, such structures are normally intended for continuous or repetitive use and are not meant as throw-away items.

Prior art structures of the type set forth above are evidenced in the following U.S. Patent Nos. 2,263,122; 2,868,411; 3,013,689; 3,256,627; 4,583,577; and 4,340,146.

Based on the above, there is still a need in the prior art for a disposable, lightweight cover structure which forms at least a minimal utilitarian function such as absorbing condensation or moisture formed on the exterior surface of a beverage can or like container. Also, such a preferred structure should be lightweight, very inexpensive and easy to produce thereby rendering it an ideal medium for advertising and/or providing such beverage containers with a decorative outer appearance. In addition, such a cover structure will naturally make handling or drinking from the container more convenient.

SUMMARY OF THE INVENTION

This invention relates to a cover assembly comprising a base defined by a continuously formed cylindrically configured wall means having a longitudinal dimension, preferably but not necessarily greater than one-half the longitudinal dimension of the beverage can or like container which it is intended to cover. Similarly, the transverse dimension is such as to surround and slidingly engage the outer surfaces of the walls of the container. The wall means terminate at one open end defining an access opening into the hollow interior of the base. The opposite end of the base may also be open. The access opening as well as the hollow interior of the base includes a transverse dimension sufficient to allow passage of the beverage container therethrough and along a vast majority of the length of the base until it reaches a support means. The support means of the present invention includes preferably a plurality of support members integrally formed in the cylindrical wall and disposed in spaced apart relation to one another generally about the periphery of the wall. The support members are attached to the walls preferably at opposite ends of the support members and are movable relative to the wall due to a hinge or pivot like connection between the opposite ends of each support member and the wall itself. In a preferred embodiment to be described in greater detail hereinafter, the support members are in fact cut from or out of the correspondingly positioned portions of the wall means and are integrally attached thereto at the opposite ends of the support members. Therefore, the support members may be selectively and independently positionable into a support position where they extend into the interior of the base in supporting, interruptive engagement with the undersurface of the beverage can or like container. Alternately, the support members may be independently positioned outwardly into a substantially aligned or co-planar relation with the segments or portions of the wall means from which they are formed.

The movement of the support members is possible because each of the support members are effectively detached from the wall portions to which they are connected, at their opposite ends, along substantially the entire length of the respective support members.

The support means including each of the support members are substantially disposed at a common level and more particularly, a common spaced distance but substantially adjacent to the opposite open end of the container relative to the open end defining the access opening to the interior thereof. This will allow the majority of the can to be disposed on the interior of the base in surrounded relation by the wall means. At the same time, the bottom of the beverage container is maintained a spaced distance from a support surface, such as a table top or the like, on which the cover means and the interiorly contained beverage container is positioned.

The base is preferably formed from a paperboard, cardboard or like lightweight extremely inexpensive material and is therefore disposable. Further, the material is such as to be somewhat water resistant and in certain embodiments may be at least minimally absorbent so as to prevent condensation or moisture normally occurring on the exterior of cold beverage containers to leak therefrom onto the supporting surface. Further, the flexible material from which the cover assembly is formed may facilitate the placing of decorative or informative indicia, such as advertising or pictorial representation, on the exterior surface thereof. Such indicia may be in the form of printing, painting, decals or any other applicable means which lends itself to inexpensive production techniques and thereby allows the cover structure to be disposable after one or more uses.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
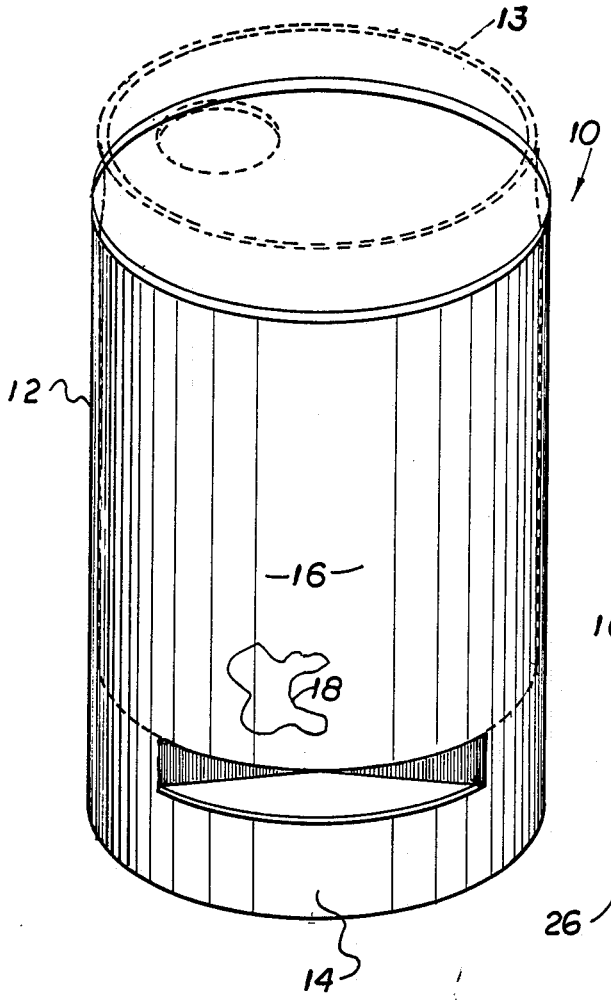
FIG. 1 is a perspective view of the cover assembly of the present invention holding a container represented in partial phantom lines.
Figure 2:
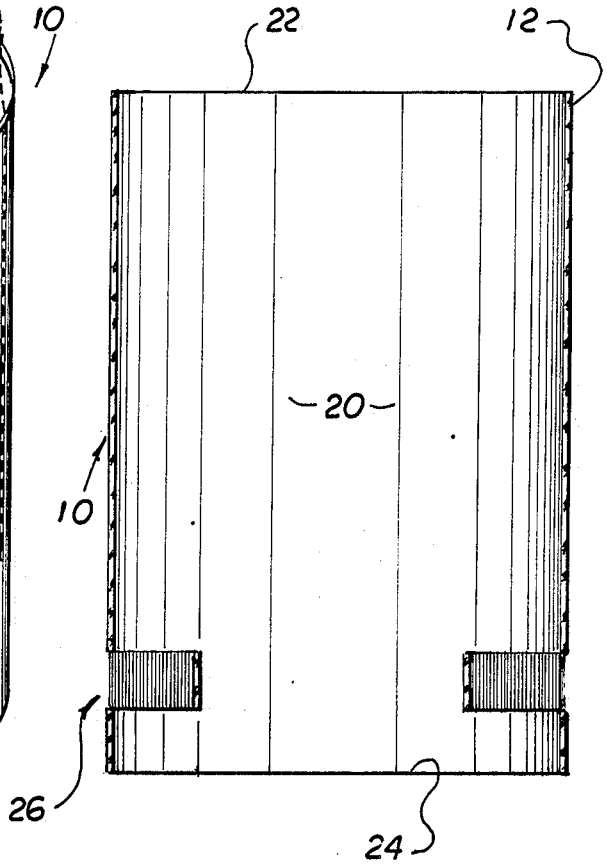
FIG. 2 is a longitudinal sectional view.

As shown in FIGS. 1 through 4, the cover assembly of the present invention is generally indicated as 10 and comprises a base 12 having a substantially hollow, cylindrical configuration of sufficient length to support preferably at least one-half of the exterior surface of a beverage can or like container 13. It should be apparent that the overall length can, of course, vary based upon preference and/or design and still be within the intended scope of the present invention.

The continuous cylindrical wall means 14 of the base 12 has an exposed outer surface as at 16 on which indicia means such as 18 may be placed. Such indicia means may be in the form of advertising, information, pictorial displays, designs, etc. and cover a pre-designated portion or substantially the entire exposed surface 16.

The hollow interior as at 20 has a transverse dimension sufficient to slidingly engage but somewhat snugly grip the exterior surface of the container 14 in a manner which will tend to keep any accumulated condensation or like moisture formed on the exterior of the container 13 from reaching the hands of the user of the assembly 10. Therefore, it should be apparent that the handling as well as the supporting of the container 13 is much more efficient and comfortable.

Figure 4:
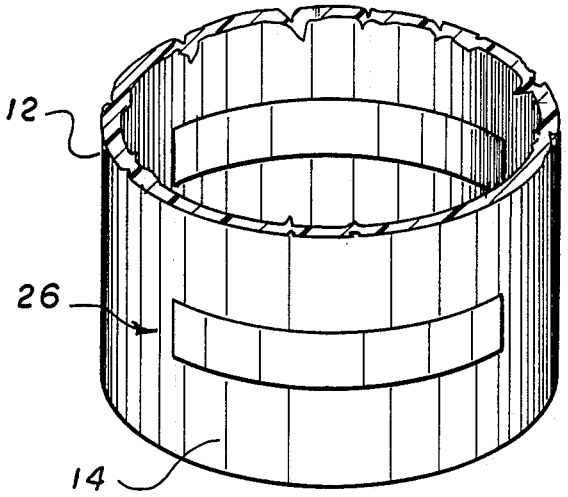
FIG. 4 is a perspective view in partial cut-away of the cover assembly with support structure formed thereon being in non-supporting position.
Figure 3:
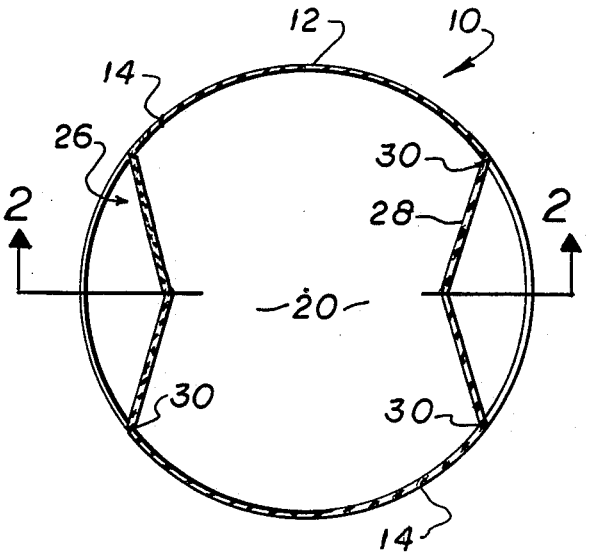
FIG. 3 is a transverse sectional view of the embodiments of FIGS. 1 and 2.

The wall means 14 and accordingly, the base 12 has an access opening defining what may be considered an upper end as at 22 and also may have an open bottom end as at 24. One important feature of the present invention is the existence of a support means generally indicated as 26 and comprising a plurality of support members 28 disposed in spaced apart relation from one another at a common "level" or more specifically, a common spaced distance from the bottom end 24. Each of the support members 28 is integrally connected at its opposite end as at 30 to the wall means 14 and such integral connection form somewhat of a hinge type structure. This hinge type structure allows the selective and independent positioning of the support members 28 between a supporting position as clearly represented in FIGS. 1, 2 and 3 and a non-supporting position as best shown in FIG. 4. The aforementioned supporting position is defined by the support members 28 extending inwardly into the interior 20 in interruptive and supporting engagement with the undersurface or bottom end of the container 13 (see FIG. 1). By virtue of this construction, the bottom of the container 13 will therefore be maintained in a spaced relation to any supporting surface on which the cover assembly 10 is disposed, such as a table top or the like. It should also be readily apparent that the movement of the support members 28 between their supporting position and non-supporting position, as best shown in FIGS. 3 and 4 respectively, may occur due to the fact that the supporting members are separated from the wall means 14 along substantially their entire length and are only connected to the wall means at the aforementioned opposite ends 30 where pivotal movement therebetween transpires.

Now that the invention has been described,

What is claimed is:

1. For use in combination with a beverage container having a bottom end and an exterior surface, a cover structure adapted to be removably mounted in covering relation to the exterior surface of the beverage container, said cover structure comprising:

a. a substantially elongate, cylindrical base formed of a substantially flexible material and including a cylindrical wall disposed in surrounding relation to a hollow interior, said cylindrical wall adapted to be folded longitudinally between a collapsed, substantially flat position and an open, cylindrical operable position, b. an access opening formed on one end of said cylindrical base dimensioned and configured to allow sliding passage of the beverage container therethrough for nested engagement within said hollow interior, c. support means disposed on an opposite end of said cylindrical base structured and configured to extend inwardly with said hollow interior in supporting relation to the bottom end of the beverage container, said support means including at least two support members having an elongate configuration and pivotally attached at opposite ends thereof to said cylindrical wall so as to be independently movable between a retracted position and a support position, d. said cylindrical wall dimensioned and configured such that an interior surface of said cylindrical wall is disposed in substantially covering, surrounding and engaging relation to the exterior surface of the beverage container, and e. said cylindrical wall including an outer surface adapted for application of decorative indicia thereon.

2. An assembly as in claim 1 wherein said access opening comprises an open configuration; said support means disposed in spaced relation to said opposite end a sufficient distance to maintain the bottom of the container in spaced relation to said opposite end.

3. An assembly as in claim 2 wherein said base includes a longitudinal dimension extending from said support means to said access, opening equal to at least one-half the length of the beverage container.

4. An assembly as in claim 2 wherein said flexible material is structured to be folded longitudinally, substantially flat upon itself.

5. An assembly as in claim 4 wherein said flexible material comprises a foldable cardboard.

6. An assembly as in claim 1 wherein said base has a lesser longitudinal dimension than the container and (said access opening) is spaced from an upper end of the container.

7. An assembly as in claim 1 wherein said support means comprises a plurality of support members, each movably attached to said wall in spaced relation to one another and collectively disposed at a common distance from said opposite end.

8. An assembly as in claim 7 wherein said support position is defined by each of said plurality of support members extending inwardly along their length from said opposite ends thereof into said hollow interior portion.

9. An assembly as in claim 8 wherein each of said support members is detached from said cylindrical wall along substantially the entire length of opposite longitudinal edges thereof.

10. An assembly as in claim 8 wherein said retracted position is defined by each of said support members disposed in substantially aligned, co-planar relation with said cylindrical wall to which it is attached.

11. An assembly as in claim 1 wherein said cylindrical wall comprises a continuous configuration extending in total covering surrounding and engaging relation to external wall surfaces of the beverage container.

* * * * *